US010712122B2

(12) United States Patent
Tervola et al.

(10) Patent No.: US 10,712,122 B2
(45) Date of Patent: Jul. 14, 2020

(54) FIREARM ACCESSORY MOUNT

(71) Applicant: Tactical Revolution, LLC, Palm Beach Gardens, FL (US)

(72) Inventors: Timo Olavi Tervola, Palm Beach Gardens, FL (US); Gerald David Benjamin, Jupiter, FL (US); Sean Richard Rosario, Parkland, FL (US)

(73) Assignee: TACTICAL REVOLUTION, LLC, Palm Beach Gardens, FL (US)

( * ) Notice: Subject to any disclaimer, the term of this patent is extended or adjusted under 35 U.S.C. 154(b) by 0 days.

(21) Appl. No.: 16/319,169

(22) PCT Filed: Jul. 18, 2017

(86) PCT No.: PCT/IB2017/054343
§ 371 (c)(1),
(2) Date: Jan. 18, 2019

(87) PCT Pub. No.: WO2018/015890
PCT Pub. Date: Jan. 25, 2018

(65) Prior Publication Data

US 2019/0277597 A1 Sep. 12, 2019

Related U.S. Application Data

(60) Provisional application No. 62/363,462, filed on Jul. 18, 2016.

(51) Int. Cl.
*F41C 23/16* (2006.01)
*F41A 3/66* (2006.01)
(Continued)

(52) U.S. Cl.
CPC ..... *F41C 23/16* (2013.01); *F41A 3/66* (2013.01); *F41A 5/18* (2013.01); *F41A 5/20* (2013.01);
(Continued)

(58) Field of Classification Search
CPC .... F41C 23/16; F41A 3/66; F41A 5/18; F41A 5/20; F41G 11/001
(Continued)

(56) References Cited

U.S. PATENT DOCUMENTS 6,381,895 B1 * 5/2002 Keeney ..... F41G 11/003 42/111
7,523,580 B1 * 4/2009 Tankersley ..... F41C 23/16 42/71.01
(Continued)

FOREIGN PATENT DOCUMENTS

RU 73726 5/2008
RU 100599 12/2010
RU 152962 6/2015

*Primary Examiner* — Stephen Johnson
*Assistant Examiner* — Benjamin S Gomberg

(57) ABSTRACT

A firearm accessory mount is an apparatus that maximizes the mounting surfaces on a firearm while allowing the interchangeability of a barrel onto and off of the firearm. The apparatus includes a left tactical rail, a right tactical rail, a gas-cylinder clamp, an upper tactical rail, and an elongated fixture with a transversal arc-shaped cross section. The left tactical rail, the right tactical rail, and the upper tactical rail allows for a variety of firearm accessories to mount onto the apparatus. The gas-cylinder clamp attaches the apparatus onto the gas cylinder. The elongated fixture braces the barrel while attached to the firearm. The arc-shaped cross-section of the elongated fixture allows the barrel to be replaced or a new barrel to be attached without altering the position and orientation of the firearm. The apparatus further includes a lower tactical rail that allows the mounting of firearm accessories beneath the gas cylinder.

11 Claims, 7 Drawing Sheets

(51) Int. Cl.
*F41A 5/20* (2006.01)
*F41G 11/00* (2006.01)
*F41A 5/18* (2006.01)

(52) U.S. Cl.
CPC ..... *F41G 11/001* (2013.01); *F41G 11/003* (2013.01)

(58) Field of Classification Search
USPC ..... 42/71.01
See application file for complete search history.

(56) References Cited

U.S. PATENT DOCUMENTS

| | | | | |
|---|---|---|---|---|
| 7,571,562 | B2 * | 8/2009 | Sutherby | F41G 11/003 42/71.01 |
| 7,770,317 | B1 * | 8/2010 | Tankersley | F41C 23/16 42/71.01 |
| 7,921,760 | B2 * | 4/2011 | Tankersley | F41A 5/26 89/191.01 |
| 9,470,480 | B2 * | 10/2016 | Kirchhoff | F41G 11/001 |
| 9,518,801 | B2 * | 12/2016 | Krebs | F41C 23/16 |
| 9,719,755 | B2 * | 8/2017 | Klotz | F41C 27/00 |
| 10,001,345 | B2 * | 6/2018 | Geissele | F41A 3/66 |
| 10,094,639 | B2 * | 10/2018 | Sessions | F41G 11/003 |
| 2012/0311910 | A1 * | 12/2012 | Mironichev | F41C 23/10 42/90 |
| 2013/0047832 | A1 | 2/2013 | Hochstrate et al. | |
| 2018/0266789 | A1 * | 9/2018 | Schatz | F41G 11/003 |
| 2019/0162503 | A1 * | 5/2019 | Keeney | F41G 11/003 |

* cited by examiner

FIREARM ACCESSORY MOUNT

The current application is a 371 of international Patent Cooperation Treaty (PCT) application PCT/IB32017/054343 filed on Jul. 18, 2017.

The PCT application PCT/IB2017/054343 claims a priority to the U.S. Provisional Patent application Ser. No. 62/363,462 filed on Jul. 18, 2016.

FIELD OF THE INVENTION

The present invention relates generally to firearm accessory mount. More specifically, the present invention is firearm accessory mount that facilitates the interchangeability of barrels on a firearm while maximizing the mountable surfaces on a firearm. The present invention provides a mount that is lightweight and releases the heat escaping the barrels mounted onto the firearm.

BACKGROUND OF THE INVENTION

Most modern firearms are equipped with standardized accessory mounting rails that allow the attachment of a variety of firearm accessories. Such firearms include optics and laser aiming devices, both of which enhance the capabilities and precision of a shooter. Typical mounting rails are oriented parallel to the barrel. More specifically, the mounting rails are typically located along the top of receivers or along various locations around the barrel. Firearms such as the M4 carbine may have a mounting rail system that surrounds the entirety of the barrel. This type of mounting rail system is compatible for the M4 as the firearm doesn't require quick barrel changes.

However, on firearms such as the M240 machine gun, barrels often overheat from repetitive firing, and in combat, the barrels need to be changed out quickly and efficiently in order to resume firing. Mounting rail systems that completely envelop the barrel, such as that of the M4 carbine, do not allow for a quick replacement of barrels. Therefore, typical mounting rail systems have rails along the sides of the barrel and beneath the barrel. The area above the barrel is left unimpeded in order to perform quick barrel changes. This arrangement however is at the expense of a rail above the barrel, limiting the mounting options for firearm accessories. The present invention provides a mounting rail system that provides mountable surface above the barrel while allowing quick and efficient barrel changes. The present invention also provides lightweight firearm accessory mount that accommodates the heating of barrels.

DETAILED DESCRIPTION OF THE INVENTION

All illustrations of the drawings are for the purpose of describing selected versions of the present invention and are not intended to limit the scope of the present invention.

Figure 1:
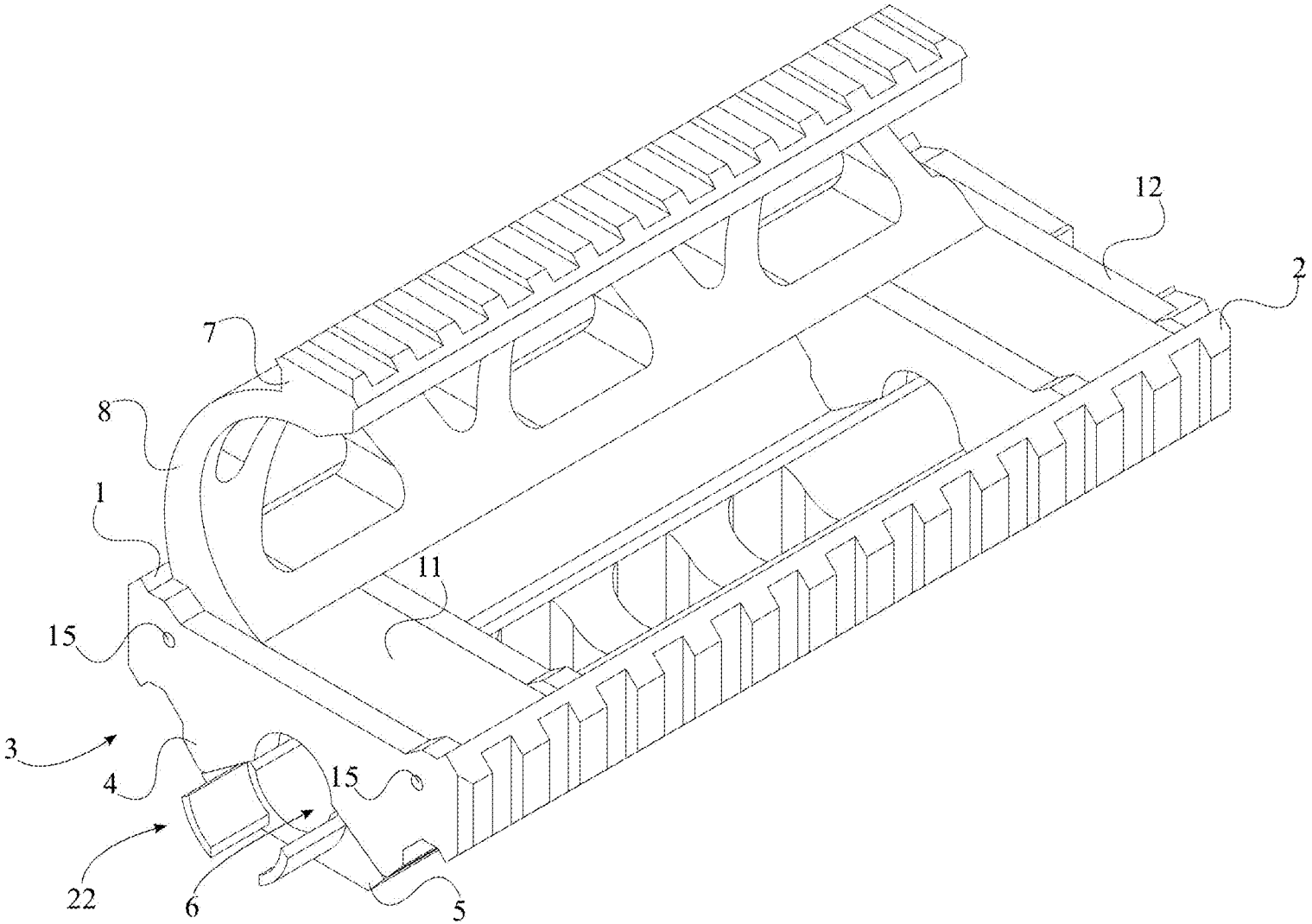
FIG. 1 is a perspective view of the present invention.
Figure 2:
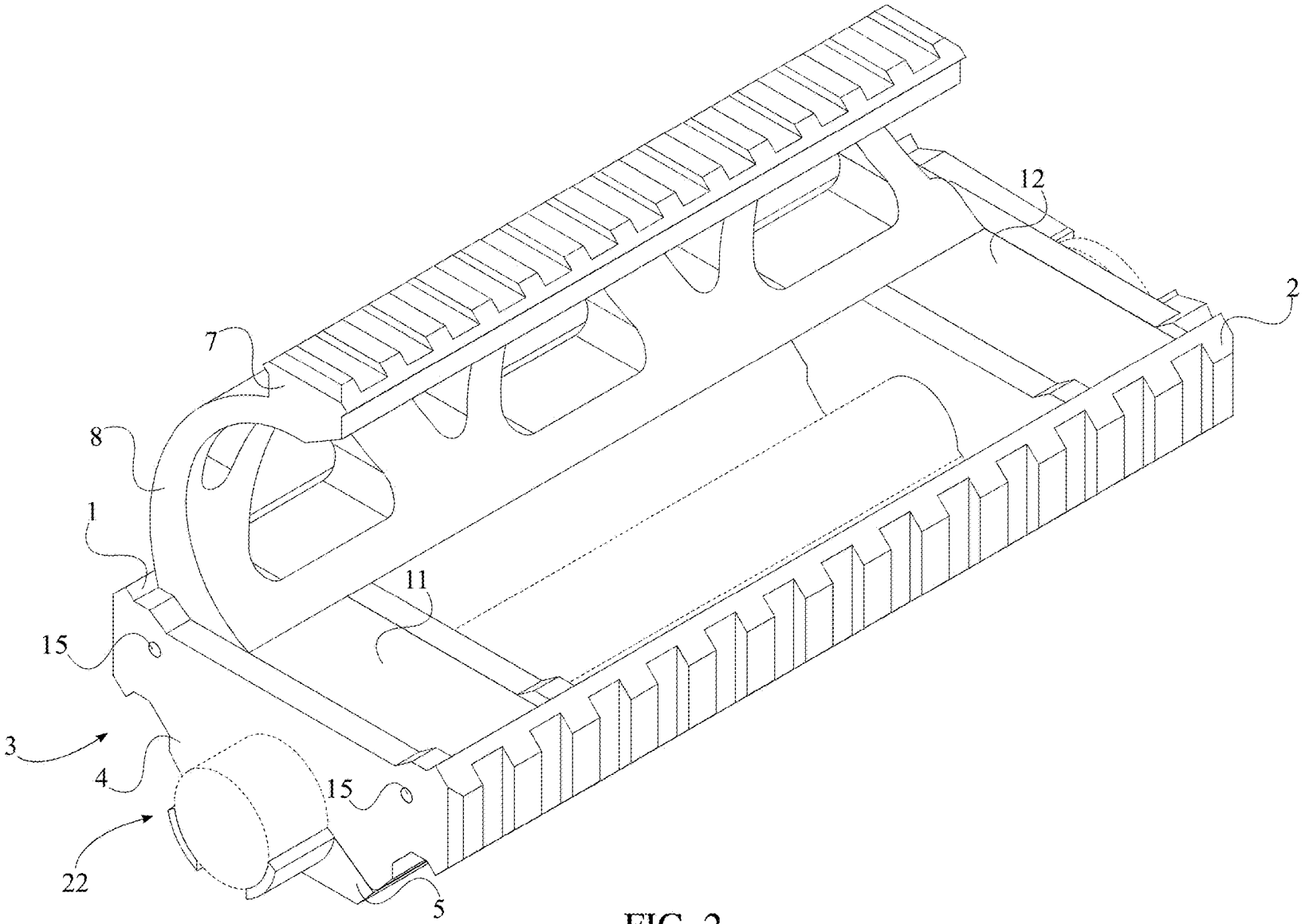
FIG. 2 is a front perspective view of the present invention engaged with a gas cylinder.

The present invention is a firearm accessory mount that allows a variety of firearm accessories to be mounted onto a firearm without obstructing the replacement of a barrel. The present invention maximizes the mountable surfaces of the firearm while facilitating the replacement of the barrel. The present invention accommodates firearms with belts that feed cartridges into the left side of the firearm and the right side of the firearm. As shown in FIG. 2, the present invention comprises a left tactical rail 1, a right tactical rail 2, a gas-cylinder clamp, an upper tactical rail 7, and an elongated fixture 8 with a transversal arc-shaped cross section. The left tactical rail 1 allows firearm accessories to attach onto the left side of the gas cylinder of a firearm. The right tactical rail 2 allows firearm accessories to attach onto the right side of the gas cylinder of the firearm. The gas-cylinder clamp mounts the present invention onto the gas cylinder of the firearm. Furthermore, the gas-cylinder clamp comprises a first elongated jaw body 4, a second elongated jaw body 5, and a cylinder-receiving hole 6, as seen in FIG. 1. The first elongated jaw body 4 positions the left tactical rail 1 and the right tactical rail 2 onto the gas cylinder of the firearm. The second elongated jaw body 5 surrounds the remainder of the gas cylinder and secures the first elongated jaw body 4 onto the gas cylinder of the firearm. The cylinder-receiving hole 6 allows the insertion of the gas cylinder within the gas-cylinder clamp. The upper tactical rail 7 allows firearm accessories to attach onto the present invention, above a barrel that is attached to the firearm. The elongated fixture 8 braces the corresponding barrel. More specifically, the arc-shaped cross section allows the interchangeability of the corresponding barrel without altering the position of the firearm or the present invention about the firearm.

Figure 7:
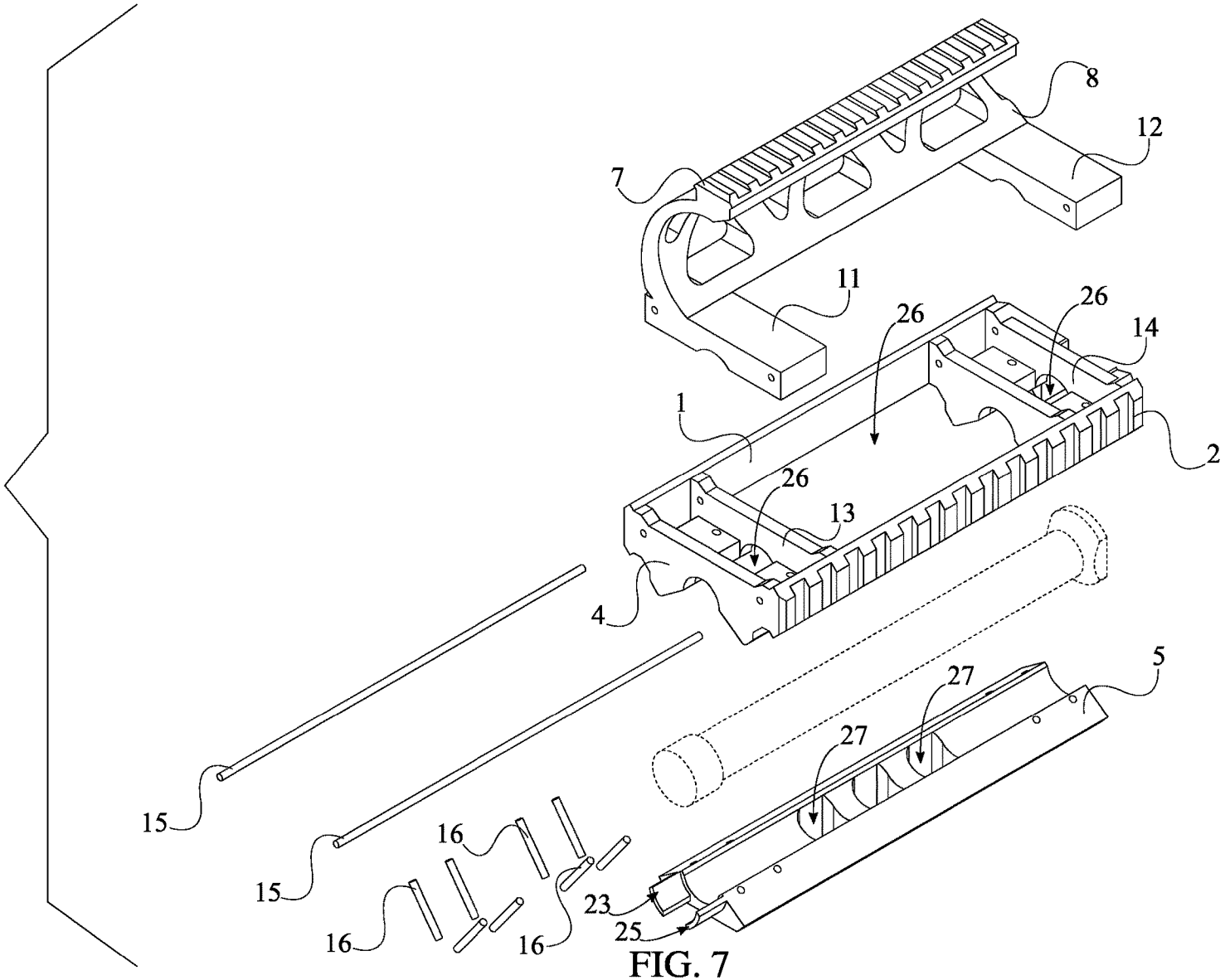
FIG. 7 is an exploded view of the present invention.

The overall arrangement of the aforementioned components allows the present invention to be attached onto the gas cylinder of a firearm and provide mountable surfaces for a variety of firearm accessories. The present is shown mounted onto a gas cylinder in FIG. 2. In order for the present invention to be attached onto a variety of gas cylinders, the first elongated jaw body 4 is detachably attached along the second elongated jaw body 5, as seen in FIG. 7. Preferably, a plurality of second fasteners 16 secures the first elongated jaw body 4 and the second elongated jaw body 5 to each other and provides a clamping force around the gas cylinder. The plurality of second fasteners 16 are shown separated from the first elongated jaw body 4 and the second elongated jaw body 5 in FIG. 7. More specifically, the first elongated jaw body 4 is connected along the second elongated jaw body 5 by the plurality of second fasteners 16. The cylinder-receiving hole 6 is delineated in between the first elongated jaw body 4 and the second elongated jaw body 5 so the gas cylinder is secured within the gas-cylinder clamp 3. As a variety of firearm accessories are meant to be mounted onto the left side and the right side of the gas cylinder, the left tactical rail 1 and the right tactical rail 2 are connected along the first elongated jaw body 4. More specifically, the left tactical rail 1 and the right tactical rail 2 are positioned opposite to each other about the cylinder-receiving hole 6.

Figure 4:
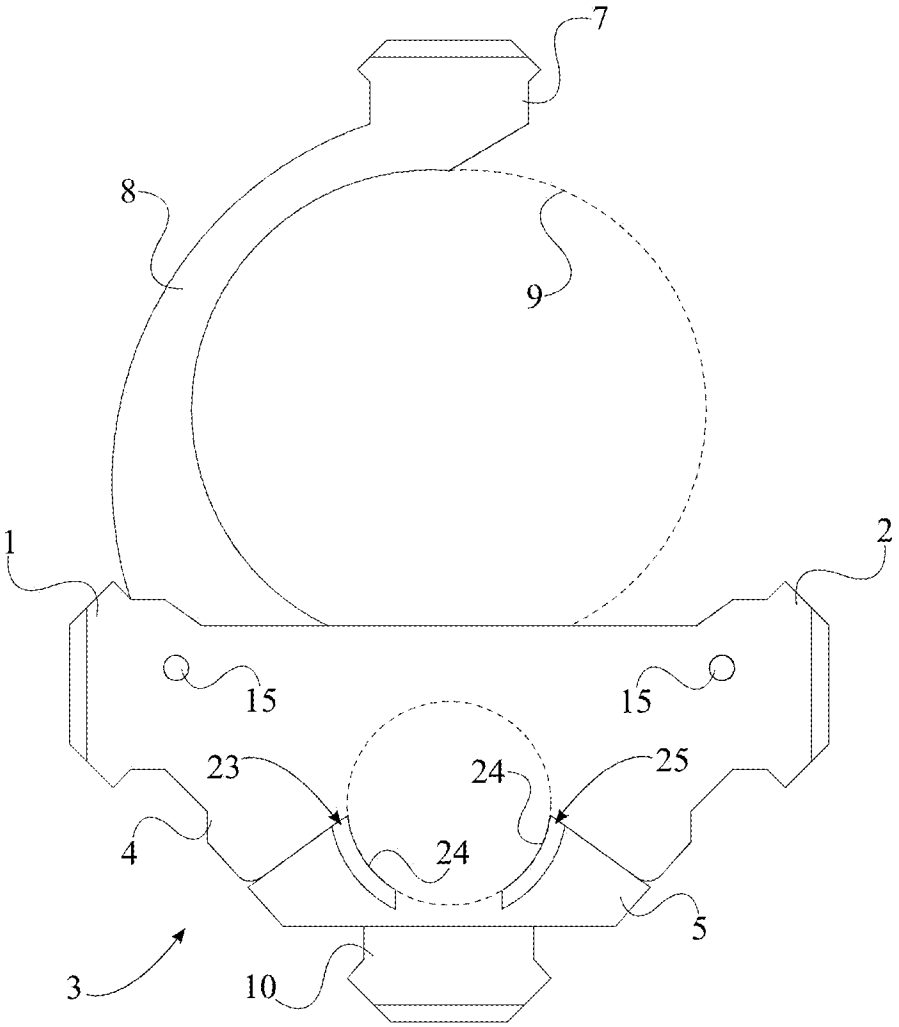
FIG. 4 is a front side view of the present invention engaged with a gas cylinder.
Figure 5:
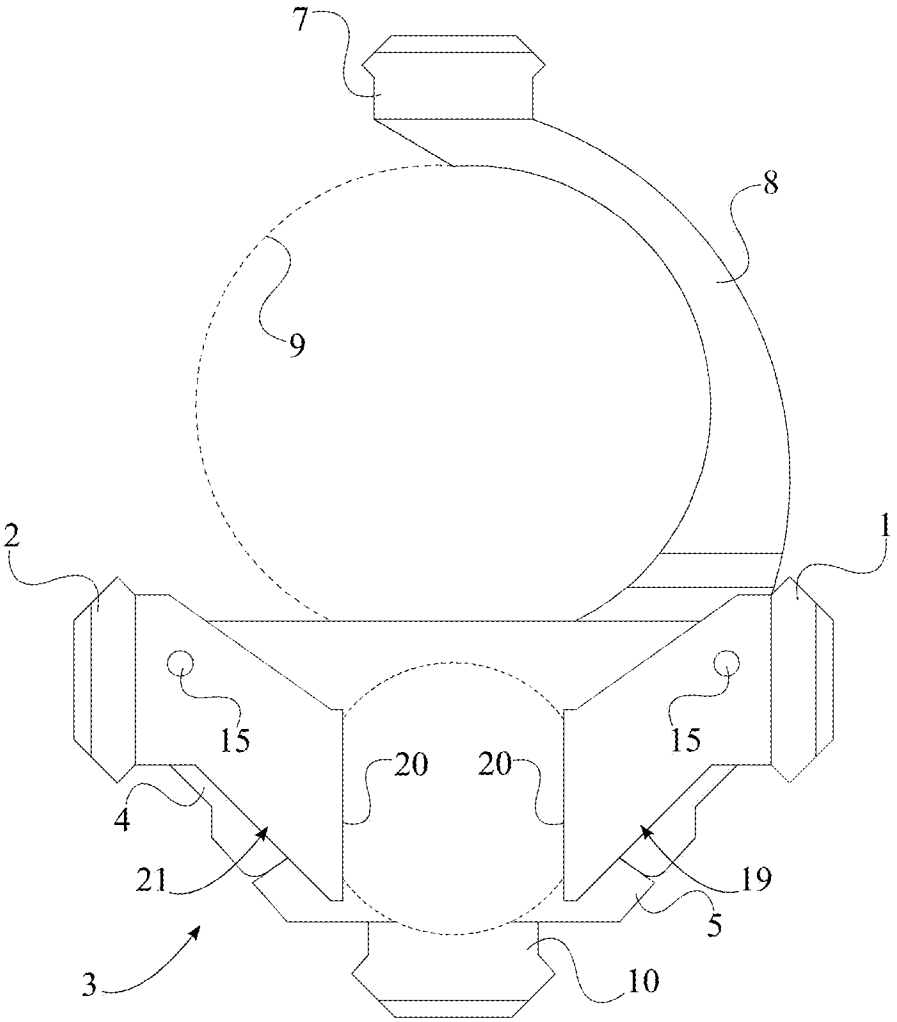
FIG. 5 is a rear side view of the present invention engaged with a gas cylinder.
Figure 6:
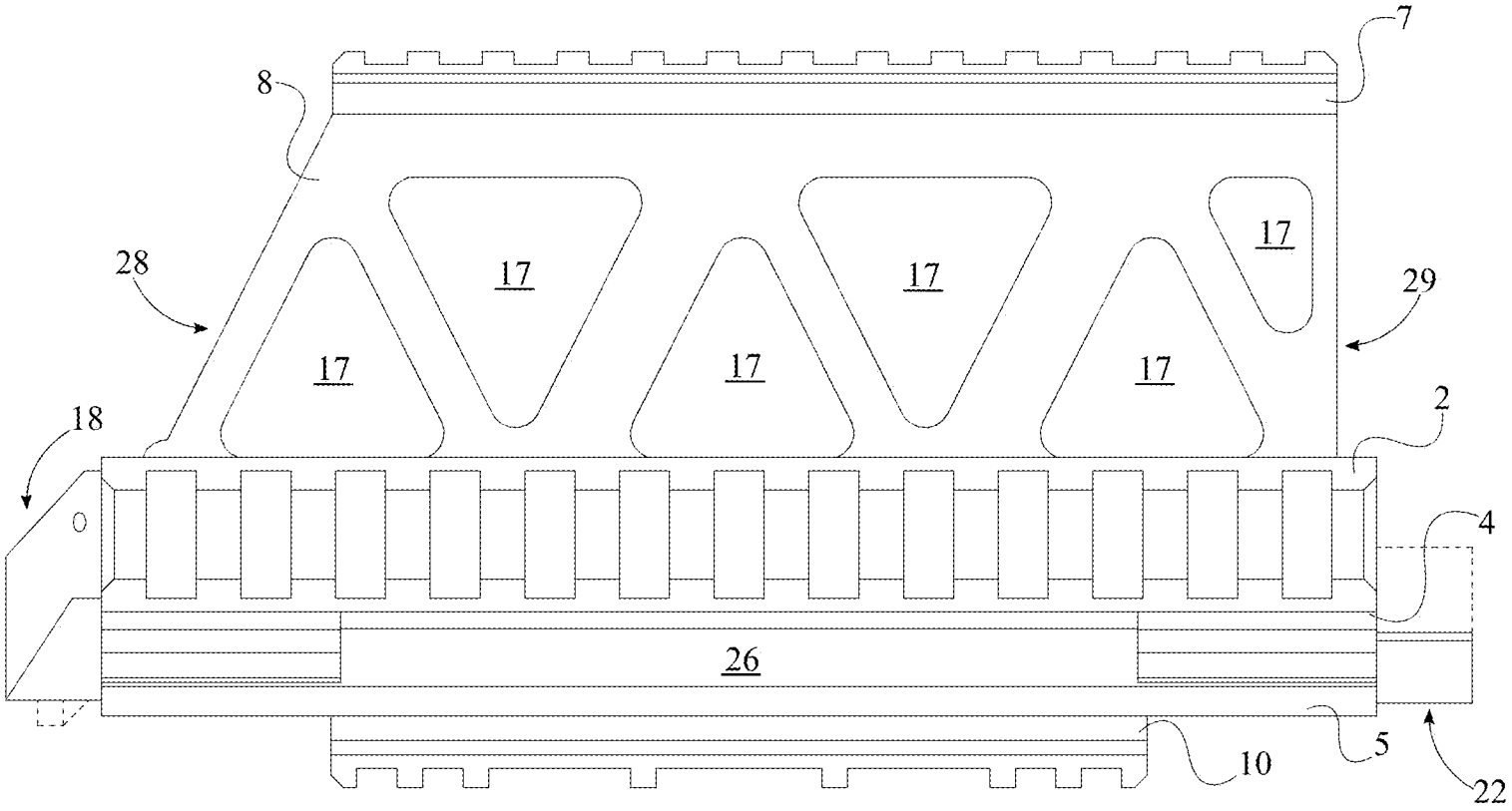
FIG. 6 is a perspective view of the present invention engaged with a gas cylinder.

In order to guide the corresponding barrel onto the gas cylinder, the elongated fixture 8 is detachably attached along the first elongated jaw body 4, opposite to the second elongated jaw, also illustrated in FIG. 7. Moreover, the elongated fixture 8 is replaceable with a variety of other firearm accessories such as heat shields. In order for the barrel to be quickly and easily replaced, a barrel receiving hole is laterally delineated by the arc-shaped fixture, as seen in FIG. 4 and FIG. 5. The barrel-receiving hole 9 accommodates the path of the corresponding barrel onto and off of the firearm. The preferred embodiment of the elongated fixture 8 further comprises a first straight edge 28 and a second straight edge 29, as illustrated in FIG. 6. The first straight edge 28 and the second straight edge 29 both accommodate the structure of the corresponding barrel and the firearm, as well as the movement of the corresponding barrel into and out of the barrel-receiving hole 9. The first straight end 28 and the second straight end 29 are positioned opposite to each other along the elongated fixture 8. More specifically, the second straight end 29 is positioned perpendicular to the barrel-receiving hole 9 and the first straight end 28 is slanted towards the second straight end 29.

In order to and attach firearm accessories above the corresponding barrel, the upper tactical rail 7 is connected along the elongated fixture 8. More specifically, the upper tactical rail 7 and the first elongated jaw are positioned opposite to each other about the barrel-receiving hole 9, allowing firearm accessories to be mounted above the corresponding barrel. In the preferred embodiment of the present invention, a lower tactical rail 10 accommodates the mounting of firearm accessories beneath the gas cylinder of the firearm. The lower tactical rail 10 is connected along the second elongated jaw body 5, opposite the first elongated jaw body 4. This configuration allows a vertical grip to connect to the gas cylinder of the firearm, among a variety of other firearm accessories.

In order to position the elongated fixture 8 onto the first elongated jaw, the preferred embodiment of the present invention comprises a first prong 11, a second prong 12, a first slot 13, and a second slot 14, illustrated in FIG. 7. The first slot 13 and the second slot 14 receive the first prong 11 and the second prong 12, respectively, as seen in FIG. 1 and FIG. 2. More specifically, the first slot 13 laterally traverses into the first elongated jaw body 4, opposite to the cylinder-receiving hole 6, and the second slot 14 laterally traverses into the first elongated jaw body 4, opposite to the cylinder-receiving hole 6. This configuration allows the elongated fixture 8 to be mounted above the gas cylinder. The first slot 13 and the second slot 14 are positioned offset from each other along the first elongated jaw body 4, in order to balance the elongated feature and any attached firearm accessories on the upper tactical rail 7 about the first elongated jaw body 4. The first prong 11 and the second prong 12 are connected along the elongated fixture 8, opposite the upper tactical rail 7, as to offset the upper tactical rail 7 and define the barrel-receiving hole 9. More specifically, the first prong 11 is engaged into the first slot 13, and the second prong 12 is engaged into the second slot 14, thereby allowing the attachment and removal of the elongated fixture 8 onto the first elongated jaw body 4. Preferably, a plurality of first fasteners 15 further secures the elongated fixture 8 to the first elongated jaw body 4, as seen in FIG. 7. The elongated fixture 8 is connected along the first elongated jaw body 4 by the plurality of first fasteners 15. The plurality of fasteners is a plurality of screws that traverses along the first elongated jaw body 4 and through the elongated fixture 8.

As the elongated fixture 8 surrounds the corresponding barrel of the firearm, the increasing temperature of the barrel must be released in order to prevent overheating of the barrel. A third set of ventilation holes 17 allows the heat to escape from the barrel, preserving the integrity of the barrel as well as that of both the elongated fixture 8 and the first elongated jaw body 4. The third set of ventilation holes 17 laterally transverse into the elongated fixture 8 and is distributed along the elongated fixture 8, illustrated in FIG. 3 and FIG. 6. This configuration maximizes the amount of heat that escapes from the barrel.

Figure 3:
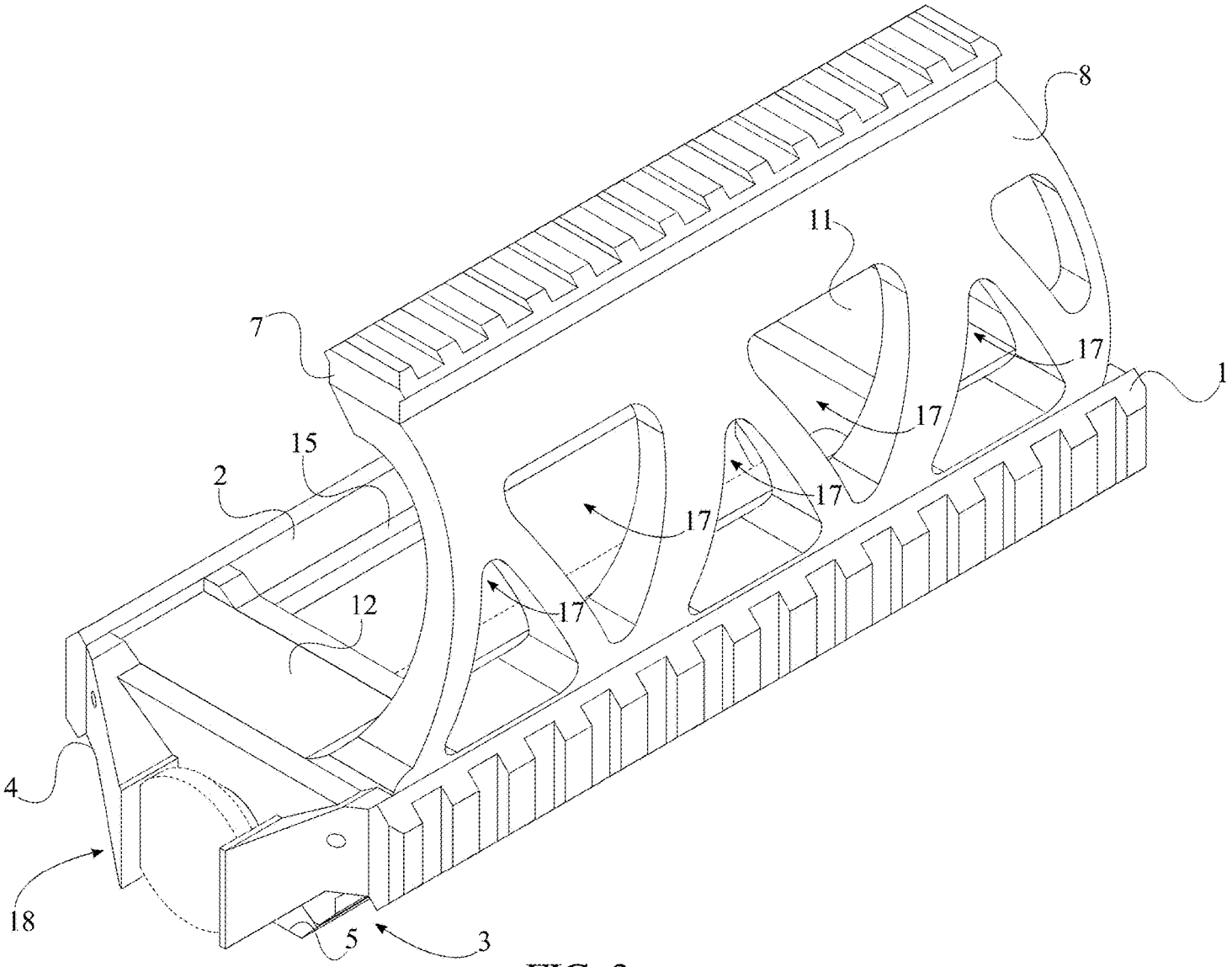
FIG. 3 is a rear perspective view of the present invention engaged with a gas cylinder.

In order to prevent the present invention from spinning, the preferred embodiment of the present invention comprises a rotation-inhibiting feature 18, shown in FIG. 3. The rotation-inhibiting feature 18 comprises a first tab 19 and a second tab 21, as seen in FIG. 5. The first tab 19 and second tab 21 are terminally connected to the first elongated jaw body 4 as to accommodate the structure of the gas cylinder. The first tab 19 and the second tab 21 are positioned parallel to each other and are tangentially positioned to the cylinder-receiving hole 6, thereby surrounding the gas cylinder. Moreover, the first tab 19 and the second tab 21 are positioned opposite to each other about the cylinder-receiving hole 6. This configuration secures the orientation of the first elongated jaw body 4 about the cylinder receiving hole.

As shown in FIG. 5, the first tab 19 and the second tab 21 preferably each comprise a faceted surface 20 which accommodates the structure of the gas cylinder, specifically, the faceted surface 20*s* of the gas cylinder. The first tab 19 and the second tab 21 ensures the orientation of the first elongated jaw body 4 about the gas cylinder. The faceted surface 20 of the first tab 19 and the faceted surface 20 of the second tab 21 are positioned parallel to each other. More specifically, the faceted surface 20 of the first tab 19 and the faceted surface 20 of the second tab 21 are oriented towards each other. An offsetting feature 22 prevents any linear movement of the present invention about the gas cylinder. The offsetting feature 22 and the rotation-inhibiting feature 18 are positioned opposite to each other along the first elongated jaw body 4, shown in FIG. 6. This configuration accommodates the structure of the gas cylinder and positions of the rotation-inhibiting feature 18 onto the gas cylinder such that the faceted surfaces of both the first tab 19 and the second tab 21 effectively press against the faceted surfaces of the gas cylinder.

In order to prevent the present invention from sliding about the gas cylinder, the preferred embodiment of the present invention comprises an offsetting feature 22, shown in FIG. 1 and FIG. 2. The offsetting feature 22 comprises a third tab 23 and a fourth tab 25. The third tab 23 and the fourth tab 25 are terminally connected to the second elongated jaw body 5 and are laterally positioned about the cylinder-receiving hole 6 as to accommodate the cylindrical structure of the gas cylinder. More specifically, the third tab 23 and the fourth tab 25 each comprises a concave surface 24, as seen in FIG. 4. The concave surface 24 encloses around the gas cylinder. In order to grasp the gas cylinder, the concave surface 24 of the third tab 23 and the concave surface 24 of the fourth tab 25 are concentrically positioned to the cylinder-receiving hole 6. A rotation-inhibiting feature 18 prevents the present invention from spinning about the gas cylinder. As seen in FIG. 6, the offsetting feature 22 and the rotation-inhibiting feature 18 are positioned opposite to each other along the second elongated jaw body 5 in order to accommodate the structure of the gas cylinder and to effectively position of the offsetting feature 22 onto the first elongated jaw body 4.

The preferred embodiment of the present invention further comprises a first set of ventilation holes 26 and a second set of ventilation holes 27, seen in FIG. 7. The first set of ventilation holes 26 allows heat to escape from the area of the gas cylinder adjacent the first elongated jaw body 4. Similarly, the second set of ventilation holes 27 allows heat to escape form the area of the gas cylinder adjacent the second elongated jaw body 5. More specifically, the first set of ventilation holes 26 laterally traverses through and is distributed along the first elongated jaw body 4. The second set of ventilation holes 27 laterally traverses through and is distributed along the second elongated jaw body 5.

Although the invention has been explained in relation to its preferred embodiment, it is to be understood that many other possible modifications and variations can be made without departing from the spirit and scope of the invention as hereinafter claimed.

What is claimed is:

1. A firearm accessory mount comprises:
a left tactical rail;
a right tactical rail;
a gas-cylinder clamp;
an upper tactical rail;
an elongated fixture with a transversal arc-shaped cross section;
the gas-cylinder clamp comprises a first elongated jaw body, a second elongated jaw body, and a cylinder-receiving hole;
the first elongated jaw body being detachably attached along the second elongated jaw body;
the cylinder-receiving hole being delineated in between the first elongated jaw body and the second elongated jaw body;
the left tactical rail and the right tactical rail being connected along the first elongated jaw body;
the left tactical rail and the right tactical rail being positioned opposite to each other about the cylinder-receiving hole;
the elongated fixture being detachably attached along the first elongated jaw body, opposite to the second elongated jaw body;
a barrel-receiving hole being laterally delineated by the elongated fixture;
the upper tactical rail being connected along the elongated fixture;
the upper tactical rail and the first elongated jaw being positioned opposite to each other about the barrel-receiving hole;
a rotation-inhibiting feature;
an offsetting feature;
the offsetting feature and the rotation-inhibiting feature being positioned opposite to each other along the first elongated jaw body;
the rotation-inhibiting feature comprises a first tab and a second tab;
the first tab and the second tab being terminally connected to the first elongated jaw body;
the first tab and the second tab being positioned parallel to each other;
the first tab and the second tab being tangentially positioned to the cylinder-receiving hole; and
the first tab and the second tab being positioned opposite to each other about the cylinder-receiving hole.

2. The firearm accessory mount as claimed in claim 1 comprises:
a lower tactical rail; and
the lower tactical rail being connected along the second elongated jaw body, opposite to the first elongated jaw body.

3. The firearm accessory mount as claimed in claim 1 comprises:
a first prong;
a second prong;
a first slot;
a second slot;
the first slot laterally traversing into the first elongated jaw body, opposite to the cylinder-receiving hole;
the second slot laterally traversing into the first elongated jaw body, opposite to the cylinder-receiving hole;
the first slot and the second slot being positioned offset from each other along the first elongated jaw body;
the first prong and the second prong being connected along the elongated fixture, opposite to the upper tactical rail;
the first prong being engaged into the first slot; and
the second prong being engage into the second slot.

4. The firearm accessory mount as claimed in claim 1 comprises:
a plurality of first fasteners; and
the elongated fixture being connected along the first elongated jaw body by the plurality of first fasteners.

5. The firearm accessory mount as claimed in claim 1 comprises:
a plurality of second fasteners; and
the first elongated jaw body being connected along the second elongated jaw body by the plurality of second fasteners.

6. The firearm accessory mount as claimed in claim 1 comprises:
a first set of ventilation holes;
a second set of ventilation holes;
a third set of ventilation holes;
the first set of ventilation holes laterally traversing through the first elongated jaw body;
the first set of ventilation holes being distributed along the first elongated jaw body;
the second set of ventilation holes laterally traversing through the second elongated jaw body;
the second set of ventilation holes being distributed along the second elongated jaw body;
the third set of ventilation holes laterally traversing into the elongated fixture; and
the third set of ventilation holes being distributed along the elongated fixture.

7. The firearm accessory mount as claimed in claim 1 comprises:
the first tab and the second tab each comprise a faceted surface;
the faceted surface of the first tab and the faceted surface of the second tab being positioned parallel to each other; and
the faceted surface of the first tab and the faceted surface of the second tab being oriented towards each other.

8. The firearm accessory mount as claimed in claim 1 comprises:
the offsetting feature comprises a third tab and a fourth tab;
the third tab and the fourth tab being terminally connected to the second elongated jaw body; and
the third tab and the fourth tab being laterally positioned about the cylinder-receiving hole.

9. The firearm accessory mount as claimed in claim 8 comprises:
the third tab and the fourth tab each comprise a concave surface; and
the concave surface of the third tab and the concave surface of the fourth tab being concentrically positioned to the cylinder-receiving hole.

10. The firearm accessory mount as claimed in claim 1 comprises:

the offsetting feature and the rotation inhibiting feature being positioned opposite to each other along the second elongated jaw body.

11. The firearm accessory mount as claimed in claim 1 comprises:

the elongated fixture comprises a first straight end and a second straight end;

the first straight end and the second straight end being positioned opposite to each other along the elongated fixture;

the second straight end being positioned perpendicular to the barrel-receiving hole; and the first straight end being slanted towards the second straight end.

* * * * *